US007614372B2

(12) United States Patent
Lichti et al.

(10) Patent No.: US 7,614,372 B2
(45) Date of Patent: Nov. 10, 2009

(54) BIAS SPRING ARBOR FOR A CAMSHAFT PHASER

(75) Inventors: Thomas H. Lichti, Victor, NY (US); Michael J. Fox, Stafford, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/540,152

(22) Filed: Sep. 29, 2006

(65) Prior Publication Data

US 2008/0078343 A1 Apr. 3, 2008

(51) Int. Cl.
*F01L 1/34* (2006.01)

(52) U.S. Cl. ..... 123/90.17; 123/90.15; 123/90.65; 464/160

(58) Field of Classification Search ..... 123/90.17, 123/90.15, 90.16, 90.18, 90.65, 90.66, 90.67; 464/1, 2, 160

See application file for complete search history.

(56) References Cited

U.S. PATENT DOCUMENTS

| | | | | |
|---|---|---|---|---|
| 6,276,321 | B1 * | 8/2001 | Lichti et al. | 123/90.17 |
| 6,405,695 | B2 * | 6/2002 | Mizutani et al. | 123/90.17 |
| 6,457,447 | B1 * | 10/2002 | Sato et al. | 123/90.17 |
| 7,165,521 | B2 * | 1/2007 | Nakajima | 123/90.17 |

* cited by examiner

*Primary Examiner*—Ching Chang
(74) *Attorney, Agent, or Firm*—Thomas N. Twomey

(57) ABSTRACT

A torque bias coil spring for a camshaft phaser disposed in an annular well formed in the phaser rotor and having a central arbor for supporting the spring. The radius of the central arbor is such that the spring has radial operating clearance of 5-10%, as in the prior art. However, the improved arbor includes regions of higher radius at the arbor ends supporting the innermost and outermost coils of the spring. These regions serve to prevent the spring from being laterally displaced during torsional motion, thus minimizing the relative motion at the spring contact points, reducing stress on the spring, and improving the efficiency of the spring by reducing frictional hysteresis.

7 Claims, 2 Drawing Sheets

BIAS SPRING ARBOR FOR A CAMSHAFT PHASER

TECHNICAL FIELD

The present invention relates to a camshaft phaser for controlling the phase relationship between the crankshaft and a camshaft of an internal combustion engine; more particularly, to a vane-type phaser having a torsion spring for biasing the rotor toward an extreme position; and most particularly, to a phaser having an improved bias spring arbor for minimizing spring stress and hysteresis.

BACKGROUND OF THE INVENTION

Camshaft phasers for varying the phase relationship between the pistons and the valves of an internal combustion engine are well known. Some prior art camshaft phasers include a torsion bias spring to bias the rotor toward an extreme rotational position. Typically, such a spring is accommodated on an arbor within a well within the rotor hub. Others may reside on the outside of the stator cover around the arbor.

A torsion spring changes diameter as it is torsionally deflected. Further, in loading such a spring, moments are inherently applied to the spring which must be counteracted in the restraint of the end coils, which twisting moments also act to distort and shift the body of the spring away from the central axis of the spring and the phaser. Further, such a spring requires radial clearance in the well, typically between about 5% and about 10% of the spring rest diameter, to allow the spring to move freely.

In prior art camshaft phasers employing a torsion coil spring as just described, the twisting moments cause the spring to be distorted off-axis and the outermost coils (end coils) of the spring to engage the walls of the arbor and, when applicable, the well, thereby increasing the frictional hysteresis of the torsional spring load, resulting in excessive wear and premature failure. The resulting observed spring rate is less than intended and the resulting observed load deflection curve includes a large amount of frictional hysteresis.

What is needed is a phaser arrangement wherein the spring end coils remain centered on the phaser axis and the other coils experience little or no contact with walls of the rotor well and arbor.

It is a principal object of the present invention to increase the observed spring rate and lower the frictional hysteresis of a torsional bias spring in a camshaft phaser.

SUMMARY OF THE INVENTION

Briefly described, a torque bias coil spring for a camshaft phaser is disposed around a central arbor for supporting the spring. The radii of the arbor is such that the spring has operating clearance of 5-10%, as in the prior art. However, the arbor includes regions of higher radius at the arbor ends supporting the innermost and outermost coils of the spring. These regions serve to prevent the spring from being laterally displaced during torsional motion, thus minimizing the relative motion at the spring contact points, reducing stress on the spring, and improving the efficiency of the spring by reducing frictional hysteresis.

BRIEF DESCRIPTION OF THE DRAWINGS

The present invention will now be described, by way of example, with reference to the accompanying drawings, in which.

DESCRIPTION OF THE PREFERRED EMBODIMENTS

Figures 1, 2:
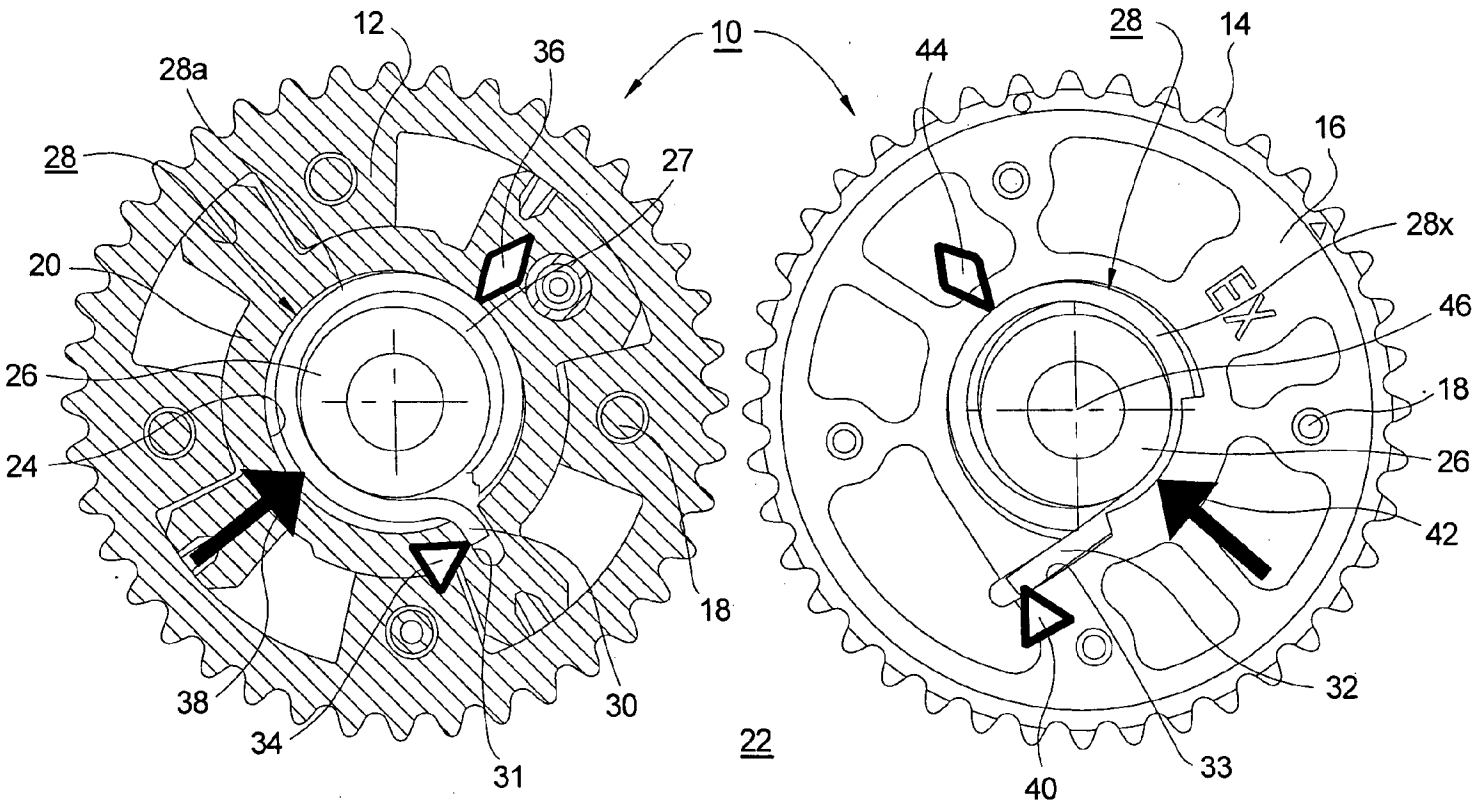
FIG. 2. (PRIOR ART)
FIG. 1. (PRIOR ART)
FIG. 1 is a cross-sectional view of a prior art phaser bias spring arrangement, taken through an innermost coil attached to a phaser rotor.
FIG. 2 is a plan view of the prior art phaser bias spring arrangement shown in FIG. 1, taken of an outermost coil attached to a front cover of a phaser.

Referring to FIGS. 1 and 2, a prior art camshaft phaser 10 includes a stator 12 driven by a sprocket wheel 14 that is bolted to a front cover 16 by bolts 18. A rotor 20 is disposed for rotation within stator 12 for attachment to an engine camshaft (not shown) to vary the timing of valves in an associated internal combustion engine 22 as is well known in the art and need not be elaborated upon here.

Rotor 20 includes an annular central well 24 surrounding a central arbor 26, defining an annular chamber 27 therebetween. A torsional coil spring 28 is disposed in chamber 27 for biasing rotor 20 into an extreme rotational position, typically a position wherein the valve overlap is minimized, at predetermined modes of operation such as engine shutdown and startup. In the cross-sectional view shown in FIG. 1, only the innermost coil 28*a* of spring 28 is visible. A radial spring tang 30 engages a slot 31 in rotor 20 to urge the rotor in a clockwise direction with respect to stator 12.

In the plan view shown in FIG. 2, only the outermost coil 28*x* of spring 28 is visible. A tangential spring tang 32 engages a slot 33 in front cover 16 to urge the stator in a counterclockwise direction with respect to rotor 20.

Spring 28 is captured under torsional stress between rotor 20 and cover 16 during assembly of phaser 10. As noted above, such torsional stress causes a deformation of spring 28, creating contact points between the spring coils and the walls of the annular well and the arbor.

Referring now to FIG. 1, open triangle 34 and open diamond 36 indicate first and second contact points, respectively, of innermost spring coil 28*a* with slot 31 and well 24, which contact restrains the torsional moment of the spring. Solid arrow 38 shows the lateral displacement of the spring against arbor 26.

The first contact point at open triangle 34 is obvious. The body of spring 28 moves off center in this direction, as indicated by arrow 38. The second contact point at open diamond 36 typically occurs approximately ¾ of a turn from tang 30, as shown. Due to the contact occurring ¾ of a turn into the active coils, there is relative motion and thus friction occurring at this contact, which increases the frictional hysteresis of the torsional spring load. Note that the diameter of arbor 26 could be increased to change the second contact point to ¼ of a turn, near arrow 38, but this would provide insufficient operating clearance for the spring, effectively binding the spring as it tightens down on the arbor during deflection (spring diameter decreases). This would cause additional increases in frictional hysteresis.

Referring to FIG. 2, the first contact, indicated by open triangle 40, occurs at tangential tang 32 in slot 33. The direction of this force causes outermost coil 28*x* to shift off-center in the direction shown by solid arrow 42. (Note that cover 16 overhangs spring coil 28*x* in this area to keep the spring axially constrained.) The second deformation contact again occurs at about ¼ of a turn, and as much as approximately ½ of a turn, from tang 32, indicated by open diamond 44. The radial shifting of the position of the two ends 30,32 of the spring causes friction and wear, and creates difficulties in configuring other parts of the phaser within the given phaser diameter. Also, the fact that the secondary contacts occur at about ¼ of a turn, and as much as approximately ½ of a turn, into the body of the spring effectively eliminates those positions of the spring from participating; thus, the spring behaves as though it had fewer coils. Therefore, the observed spring rate is not as low as intended, and the observed load deflection curve includes a large amount of frictional hysteresis.

Figure 4:
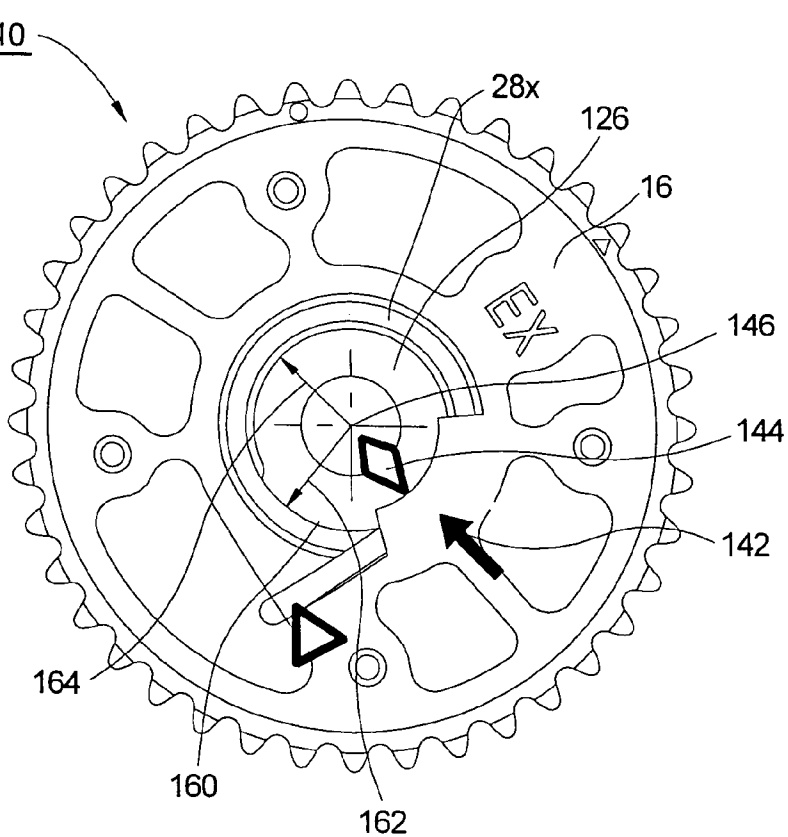
FIG. 4 is a plan view of the improved phaser bias spring arrangement shown in FIG. 3, taken of an outermost coil attached to a front cover of a phaser.
Figure 3:
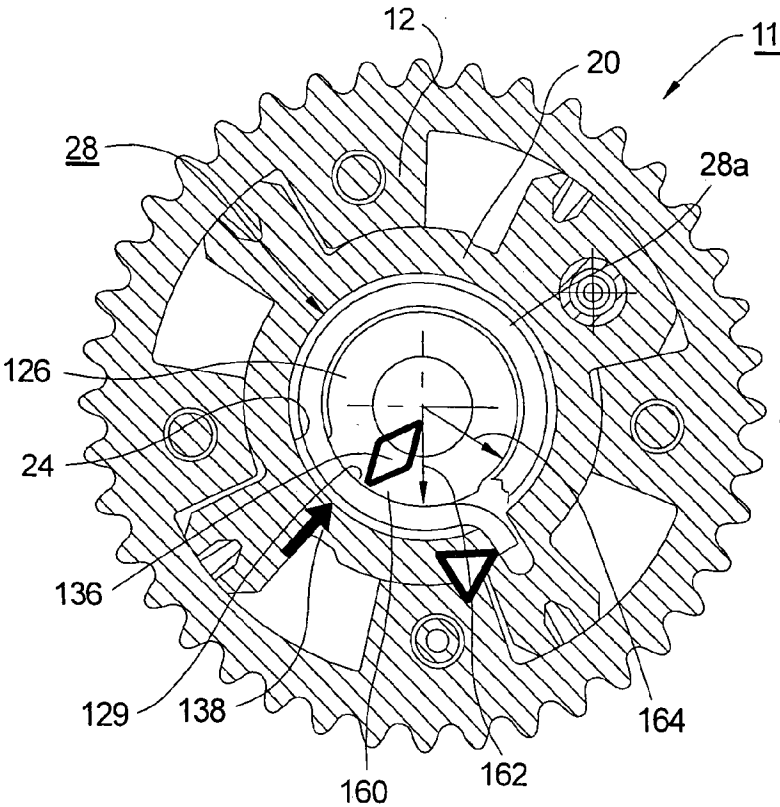
FIG. 3 is a cross-sectional view of an improved phaser bias spring arrangement in accordance with the invention, taken through an innermost coil attached to a phaser rotor.

Referring now to FIGS. 3 and 4, an improved phaser 110 is similar in most respects to prior art phaser 10. Several redundant part numbers are omitted for clarity of presentation but should be assumed.

In the example shown, rotor 20 includes an annular well 24 surrounding an improved central arbor 126. Torsional coil spring 28 is disposed in well 24 and is connected to rotor 20 and cover 16 as in the prior art.

Improved arbor 126 provides the recommended 5% to 10% operating clearance to spring 28 as in the prior art, over the middle coils of the spring, at a radius 164 exemplary of the prior art arbor radius. However, over the first ¼ turn at each end of spring 28, arbor 126 is provided with a larger diameter angular region 160 having a radius 162 substantially equal to (but slightly less than, to permit assembly of the spring onto the arbor) the inner radius 129 of spring 28. Radius 162 thus is greater than the radius 164 of the intermediate portion of the arbor adjacent the intermediate spring coils between the innermost and outermost coils. Angular region 160 thus becomes the de facto inner bearing surface for spring 28 during rotation of the spring about the arbor with the rotor 20 and the cover 16 at the innermost and outermost spring ends, respectively. The radial deformation of the spring, seen at arrows 38,42 in FIGS. 1 and 2, is essentially eliminated by regions 160 at corresponding arrows 138,142 and open diamonds 136,144 in FIGS. 3 and 4.

The present invention radially constrains end coils 28*a*,28*x* in a manner to avoid frictional contacts beyond the first ¼ turn at both spring ends, which minimizes frictional losses and functionally adds nearly a full turn to the spring. Also, the coils are supported in a manner to keep the deflected coil diameter centered on the phaser axis 146 during actuation of the phaser and minimizes phaser contact with the remainder of the coils.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A spring assembly for rotationally biasing a rotor with respect to a stator in a camshaft phaser, comprising:

a central spring arbor connected to said rotor; and a torsional spring surrounding said central spring arbor and having a plurality of helically-arranged coils including an innermost coil at an inner end thereof, an outermost coil at an outer end thereof, and at least one intermediate coil between said innermost coil and said outermost coil, said torsional spring having an inner radius;

wherein one of said innermost and outermost coils is operationally connected to said rotor and the other of said innermost and outermost coils is operationally connected to said stator;

wherein a first radius of said central spring arbor adjacent said at least one intermediate coil is less than said inner radius of said torsional spring; and wherein a second radius of said central spring arbor adjacent said innermost and outermost coils over an angular region thereof is greater than said first radius.

2. A spring assembly in accordance with claim 1 wherein said second radius of said central spring arbor is slightly less than said inner radius of said torsional spring.

3. A spring assembly in accordance with claim 1 wherein said angular region at said innermost coil is disposed at a location about one-quarter of a coil revolution from said inner end of said torsional spring.

4. A spring assembly in accordance with claim 1 wherein said angular region at said outermost coil is disposed at a location about one-quarter of a coil revolution from said outer end of said torsional spring.

5. A spring assembly in accordance with claim 1 wherein said outermost coil is operationally connected to said stator.

6. A spring assembly in accordance with claim 1 wherein said innermost coil is operationally connected to said stator.

7. A camshaft phaser, comprising:

a stator;

a rotor disposed for rotation within said stator; and a spring assembly for rotationally biasing said rotor with respect to said stator, said spring assembly including a central spring arbor connected to said rotor, and a torsion spring surrounding said central spring arbor, said torsion spring having a plurality of helically-arranged coils including an innermost coil at an inner end thereof, an outermost coil at an outer end thereof and at least one intermediate coil between said innermost coil and said outermost coil, said torsion spring having an inner radius;

wherein said innermost coil is operationally connected to said rotor and said outermost coil is operationally connected to said stator;

wherein a first radius of said central spring arbor adjacent said at least one intermediate coil is less than said inner radius of said torsion spring; and wherein a second radius of said central spring arbor adjacent said innermost and outermost coils over an angular region thereof is greater than said first radius.

* * * * *